US009510085B1

(12) United States Patent
Daravong

(10) Patent No.: US 9,510,085 B1
(45) Date of Patent: Nov. 29, 2016

(54) HEADPHONE AUDIO SYSTEM

(71) Applicant: Atticus Daravong, Bedford, TX (US)

(72) Inventor: Atticus Daravong, Bedford, TX (US)

(73) Assignee: Atticus Daravong, Euless, TX (US)

( * ) Notice: Subject to any disclaimer, the term of this patent is extended or adjusted under 35 U.S.C. 154(b) by 0 days.

(21) Appl. No.: 14/941,314

(22) Filed: Nov. 13, 2015

Related U.S. Application Data

(60) Provisional application No. 62/079,040, filed on Nov. 13, 2014.

(51) Int. Cl.
*H04R 1/10* (2006.01)

(52) U.S. Cl.
CPC ..... *H04R 1/1091* (2013.01); *H04R 2420/07* (2013.01)

(58) Field of Classification Search
CPC ..... H04R 1/1091; H04R 2420/07
See application file for complete search history.

(56) References Cited

U.S. PATENT DOCUMENTS

2010/0093275 A1* 4/2010 Yoshino ..... H01Q 1/241 455/14

* cited by examiner

*Primary Examiner* — Ping Lee
(74) *Attorney, Agent, or Firm* — Eldredge Law Firm; Richard Eldredge

(57) ABSTRACT

A wireless adaptor for Bluetooth compromising a body, a power source, an adaptor wherein the adaptor attaches to a headphone and wherein the receiver communicates with a headphone.

3 Claims, 4 Drawing Sheets

HEADPHONE AUDIO SYSTEM

BACKGROUND

1. Field of the Invention

The present invention relates generally to audio systems, and more specifically to headphones.

2. Description of Related Art

Headphones are well known in the art and are effective means to provide portable audio to a user. For example, FIG. 1 depicts an oblique view of a headphone audio system 101 having headphones 100 operably associated with an audio source 102. The headphone 100 is configured to fit around the head of the user 104 (shown in phantom) from ear to ear and includes a first ear speaker 103 and a second ear speaker 105. In the exemplary embodiment the audio device communicates with a mobile phone 107 configured to transmit music to the headphones 100 via a wire 109.

It will be appreciate that system 101 effectively provides audio to the user; however, significant disadvantages exist when using a wire 109. For example, the wire 109 has a propensity to tangle and restricts movement access of the user such as requiring the user to hold mobile phone 107 during use.

To overcome these problems, there exist headphones audio systems 201 configured to wirelessly transmit the audio from audio source 202 to headphones 200. Like headphones 100, the exemplary embodiment also includes a first ear speaker 203 and a second ear speaker 207; however, the embodiment is also provided with a receiver 207 supported by second ear speaker 207 and configured to wirelessly receive audio data from mobile device 209.

A common disadvantage associated with system 201 is the limited use. Specifically, the system includes a receiver 207 that is already built into the headphones 200, thereby restricting the audio source 202 to already manufactured headphones. Thus, the features of system 201 can not be retrofitted on existing headphones.

Although great strides have been made in the area of headphones, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
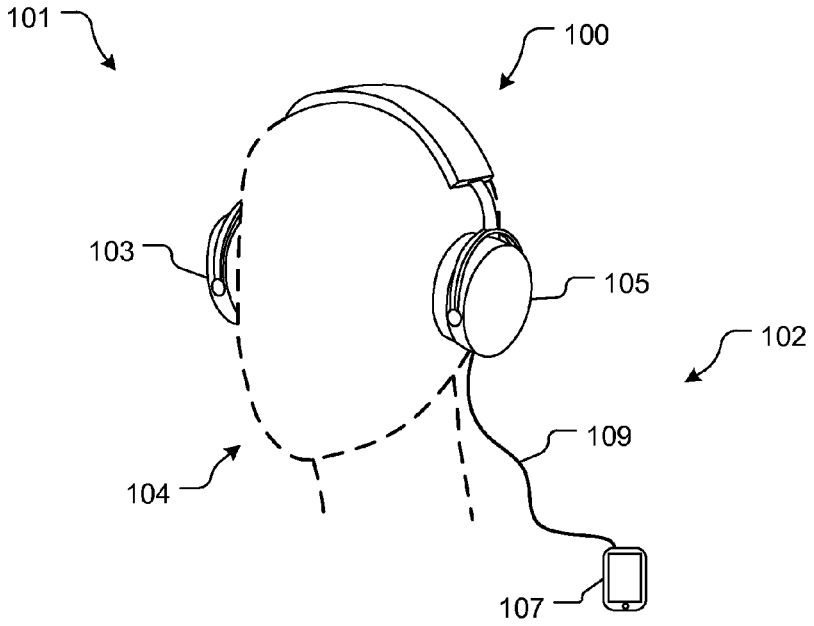
FIGS. 1 and 2 are oblique views of conventional headphone audio systems.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional headphone audio systems. Specifically, the system of the present application is configured to provide rapid and effective means to receive audio from an audio device wirelessly. The system can also configured to receive and transport phone calls to the headphones via the audio device. The system is optionally provided with a range tracker configured to determined the distance of the audio receiver relative to the audio source and configured to adjust between different frequencies, e.g., RFID, Bluetooth, and/or WiFi to receive the data communication. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
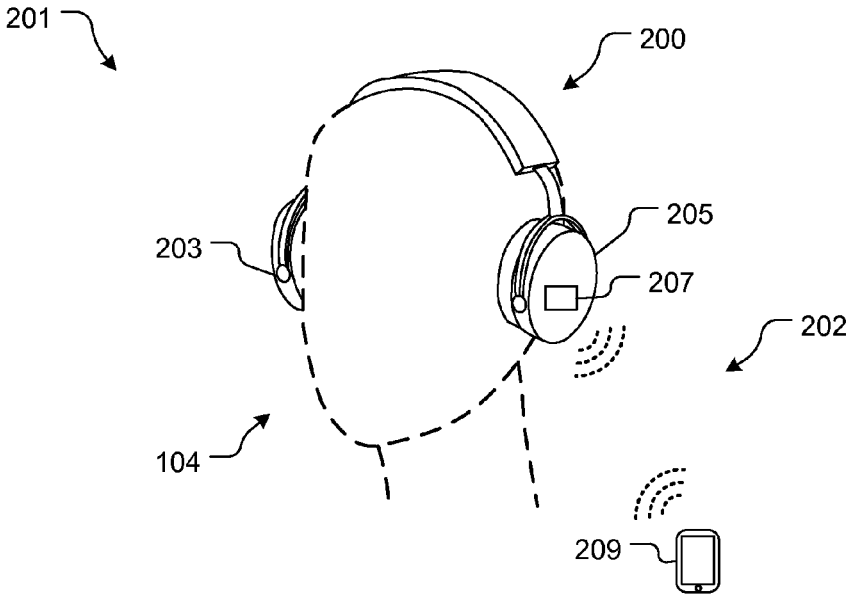
Figure 3:
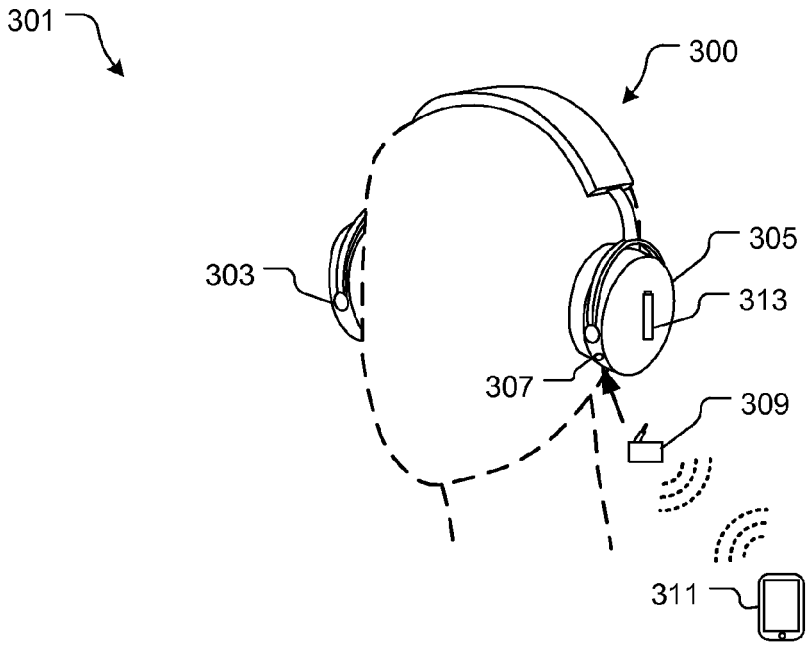
FIG. 3 is an oblique view of headphone audio system in accordance with a preferred embodiment of the present application.

Referring now to the drawings wherein like reference characters identify corresponding or similar elements throughout the several views, FIG. 2 depicts a simplified front view of a headphone audio system 301 in accordance with a preferred embodiment of the present application. It will be appreciated that the system 301 overcomes one of more of the above-listed problems commonly associated with the conventional headphone audio systems.

In the contemplated embodiment, system 301 includes headphones 300 having two ear speakers: first ear speaker 303 and second ear speaker 305. Headphones 300 is further provided with a port 307 configured to receive a plug 407 operably associated with an audio receiver device 309 (see, e.g., FIG. 4). During use, the audio receiver device 309 removably attaches to second ear speaker 303 via plug 407 and port 307.

One of the unique features believed characteristic of the present application is the ability to removably attach audio receiver device 309 to the headphones via port 307. Another unique feature is the ability to wireless communicate the data to the headphones via an audio source 311. To achieve this feature, audio device includes a receiver 411 configured to communicate with audio source 311, preferably via Bluetooth technology.

Another unique feature believed characteristic of the present application is the ability to recharge the batteries 413 operably associated with the audio receiver device with batteries 313 carried within one or more of the ear speakers.

Figure 4:
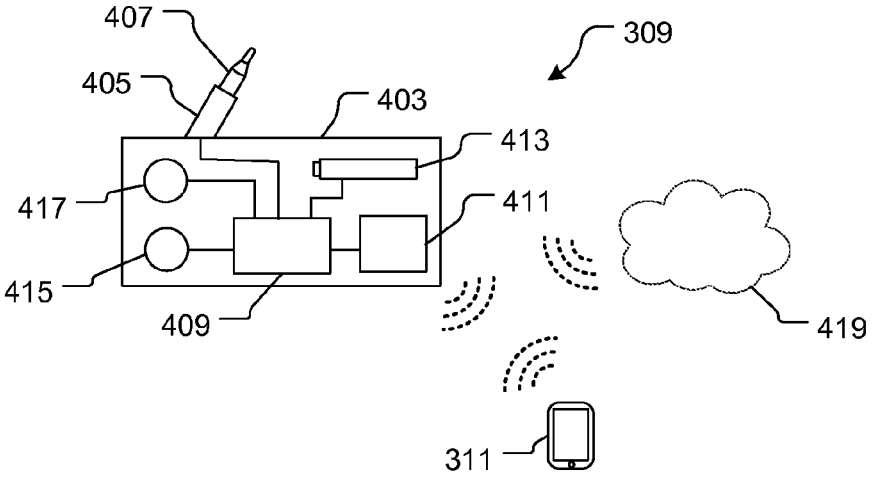
FIG. 4 is a simplified schematic of the audio device of the audio system of FIG. 3.

As depicted in the simplified schematic of FIG. 4, the audio receiver device 309 includes a plug 407 attached to a shaft 405, which in turn is pivotally attached to the body 403 of the device. During use, the plug pivots between extended and folded positions, as depicted in FIGS. 5A and 5B.

Audio receiver device 309 is further provided with a processor 409 in data communication with the plug 407 and receiver 411. A battery 413 is carried within body 403 and is conductively coupled to the processor 409 and other components of device 309. In one exemplary embodiment, the audio receiver device 309 is further provided with a microphone 415 and a switch 417. During use, the receiver 411 communicates with audio source 311 and/or data over the internet, as depicted by cloud 313.

Another unique feature believed characteristic of the present application is the ability to make and receive phone calls via device 309 with the microphone and button. Thus, any existing headphone can be used to send and receive phone calls with device 309.

Figure 5B:
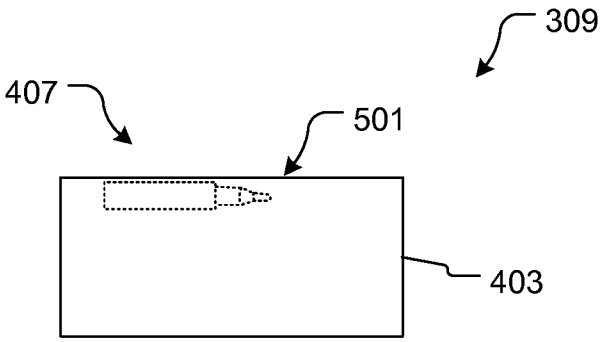
FIGS. 5A and 5B are side views of the audio device of FIG. 4.
Figure 5A:
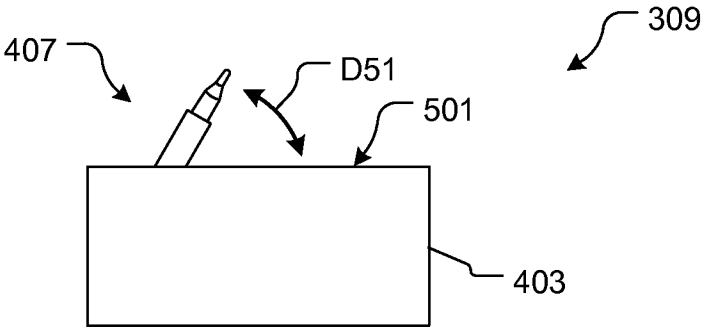
Figure 6:
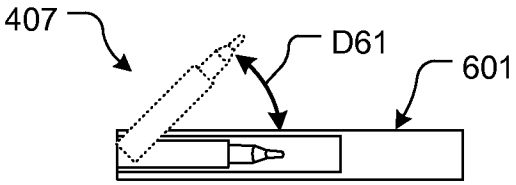
FIG. 6 is a top view of the audio device of FIG. 5B.

In FIGS. 5A, 5B, and 6, side and top views, respectively, of the device 309 are shown. As depicted, the plug 407 pivots in direction D51 relative to a top surface 501 and rotates in direction D61 relative to a side surface 601. The rotational movement D61 is an optional feature.

Figure 7:
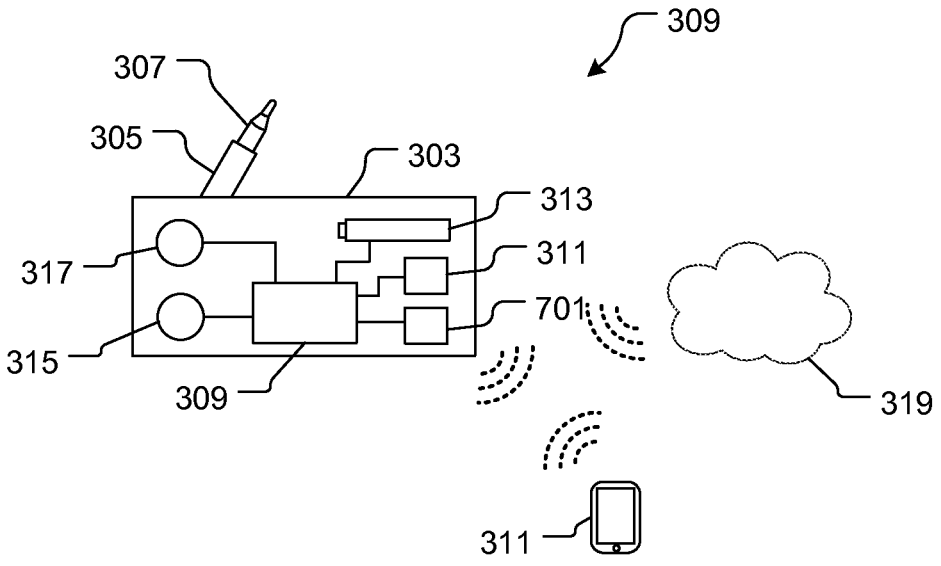
FIG. 7 is a simplified schematic of an audio device of an audio system in accordance with an alternative embodiment of the present application.
Figure 8:
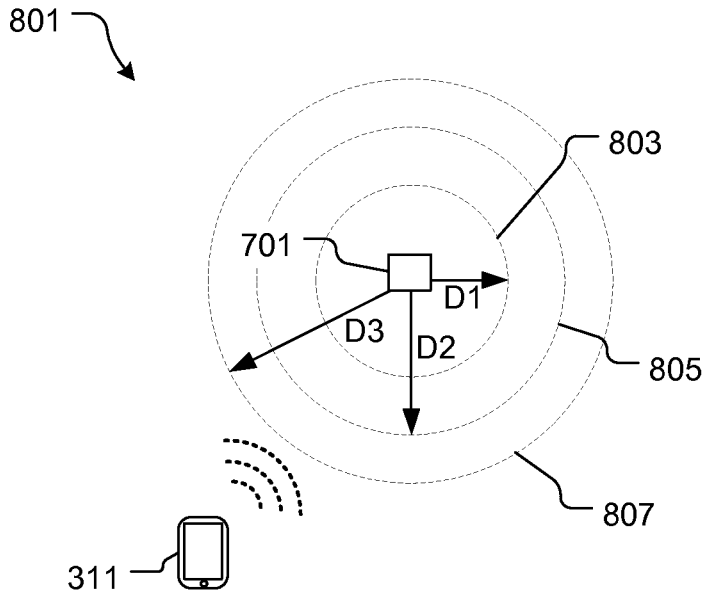
FIG. 8 is a range chart of the range finder of the audio device of FIG. 7.

As depicted in FIG. 7, an alternative embodiment of the audio receiver device is shown and is substantially similar in form and function to the audio receiver device 309; however, in the contemplated embodiment, the device includes a range finder 701, as discussed above. In FIG. 8, a chart 801 shows the different ranges 803, 805, 807 having respective distances D1, D2, and D3 from the range finder 701 to the audio source 311. In the contemplated embodiment, the range finder determines the distance relative to the audio receiver and changes the frequency required to communication with the audio source.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A headphone audio device, comprising:

a body having:

an inner cavity;

a top surface;

a channel extending inwardly from the top surface into the inner cavity;

a processor carried within the cavity;

a wireless receiver in data communication with the processor;

a plug configured to fit within a port of an ear speaker and is conductively coupled to the processor;

a shaft pivotally secured body and configured to attach the plug to the body, the shaft is configured to fit within the channel and pivots between an extended and folded position within the channel and relative to the top surface of the body; and a power source conductively coupled to the processor;

wherein the plug attaches to a headphone; and wherein the receiver communicates with an external audio device.

2. The headphone audio device of claim 1, further comprising:

a range finder disposed within the inner cavity and conductively coupled to the processor;

wherein the range finder is configured to determine a distance between the headphone audio device and the external audio device.

3. The headphone audio device of claim 2, wherein the range finder is configured to switch between different frequencies as the distance between the headphone audio device and the external audio device increases.

* * * * *